US007194873B2

(12) United States Patent
Otake et al.

(10) Patent No.: US 7,194,873 B2
(45) Date of Patent: Mar. 27, 2007

(54) REFRIGERATING MACHINE AND INTERMEDIATE-PRESSURE RECEIVER

(75) Inventors: Masahisa Otake, Gunma (JP); Hiroshi Mukaiyama, Gunma (JP); Koji Sato, Gunma (JP); Kunie Sekigami, Gunma (JP); Kazuaki Shikichi, Tochigi (JP)

(73) Assignees: Sanyo Electric Co., Ltd., Osaka (JP); Sanyo Air-Conditioners Corporation, Gunma (JP)

( * ) Notice: Subject to any disclaimer, the term of this patent is extended or adjusted under 35 U.S.C. 154(b) by 107 days.

(21) Appl. No.: 11/151,545

(22) Filed: Jun. 14, 2005

(65) Prior Publication Data

US 2005/0279128 A1 Dec. 22, 2005

(30) Foreign Application Priority Data

Jun. 18, 2004 (JP) ..... P2004-180771

(51) Int. Cl.
*F25B 43/00* (2006.01)

(52) U.S. Cl. ..... 62/512; 62/498

(58) Field of Classification Search ..... 62/471, 62/498, 503, 512
See application file for complete search history.

(56) References Cited

U.S. PATENT DOCUMENTS 4,438,635 A * 3/1984 McCoy, Jr. ..... 62/305
4,689,969 A * 9/1987 Van Steenburgh, Jr. ..... 62/474
6,032,473 A * 3/2000 Morimoto et al. ..... 62/205

FOREIGN PATENT DOCUMENTS

JP 2804527 3/1991

* cited by examiner

*Primary Examiner*—Melvin Jones
(74) *Attorney, Agent, or Firm*—McDermott Will & Emery LLP

(57) ABSTRACT

A refrigerating machine equipped with a compressor 2 having an intermediate-pressure portion 2M in which refrigerant having intermediate pressure higher than the pressure of the refrigerant at the suction side thereof and lower than the pressure of the refrigerant at the discharge side thereof can be introduced, and an intermediate-pressure receiver 28 that is inserted in a flow path between an expansion valve 27*a* (27*b*) of a heat source side heat exchanger 3*a* (3*b*) and an expansion valve 18*a* (18*b*) of a using side heat exchanger 6*a* (6*b*), carries out gas-liquid separation on gas-liquid mixed refrigerant after the heat exchange in the heat source side heat exchanger or the using side heat exchanger, and then feeds gas-phase refrigerant to the intermediate-pressure portion 2M.

17 Claims, 10 Drawing Sheets

REFRIGERATING MACHINE AND INTERMEDIATE-PRESSURE RECEIVER

BACKGROUND OF THE INVENTION

1. Field of the Invention

The present invention relates to a refrigerating machine that has an outdoor unit and a plurality of indoor units and can carry out heating operation or cooling operation on these plural indoor units at the same time or carry out heating operation and cooling operation in a mixture style, and an intermediate-pressure receiver that is used in the refrigerating machine concerned and carries out gas-liquid separation of gas-liquid mixture refrigerant.

2. Description of the Related Art

There is generally known a refrigerating machine in which an outdoor unit is a plurality of indoor units through an inter-unit pipe comprising a high-pressure gas pipe, a low-pressure gas pipe and a liquid pipe to enable cooling operation or heating operation to be carried out on the plural indoor units at the same time or to enable both cooling operation and heating operation to be carried out on the plural indoor units in a mixing style (see Japanese Patent No. 2804527). In this specification, it is assumed that the refrigerating machine contains a heat pump.

In this type of refrigerating machine, when the temperature of a heat source heat-exchanged with refrigerant in a high-pressure side heat exchanger used as a radiator increases, the compression driving force is increased, the performance of evaporating heat transfer is lowered and the pressure loss in an evaporator is also increased, so that the performance of the refrigerating machine is lowered.

SUMMARY OF THE INVENTION

Therefore, an object of the present invention is to provide a refrigerating machine in which the performance thereof can be kept and enhanced even when the temperature of a heat source heat-exchanged with refrigerant in a high-pressure side heat exchanger used as a radiator increases, and an intermediate-pressure receiver used in the refrigerant machine.

In order to attain the above object, according to a first aspect of the present invention, a refrigerating machine equipped with an outdoor unit containing a compressor and an outdoor heat exchanger serving as a heat-source side heat exchanger, a plurality of indoor units each of which contains an indoor heat exchanger as a using side heat exchanger and is connected to the outdoor unit through an inter-unit pipe, one end of the outdoor heat exchanger being selectively connected to any one of a refrigerant discharge pipe and a refrigerant suction pipe of the compressor, the inter-unit pipe comprising a high-pressure pipe connected to the refrigerant discharge pipe, a low-pressure pipe connected to the refrigerant suction pipe and an intermediate-pressure pipe connected to the other end of the outdoor heat exchanger, and one end of the indoor heat exchanger of each of the indoor units being selectively connected to any one of the high-pressure pipe and the low-pressure pipe while the other end of the indoor heat exchanger concerned is connected to the intermediate-pressure pipe, whereby the plural indoor units carry out any one of cooling operation and heating operation at the same time or carry out both cooling operation and heating operation in mixture at the same time, is characterized in that the compressor has an intermediate-pressure portion in which refrigerant having intermediate pressure higher than the pressure of the refrigerant at the suction side of the compressor and lower than the pressure of the refrigerant at the discharge side of the compressor is allowed to be introduced, and an intermediate-pressure receiver that is inserted in a refrigerant flow path between the heat-source side heat exchanger and the using side heat exchanger to carry out gas-liquid separation on gas-liquid mixed refrigerant after heat exchange in the heat-source side heat exchanger or the using side heat exchanger and then feed gas-phase refrigerant to the intermediate-pressure portion.

According to the present invention, the intermediate-pressure receiver is inserted in the flow path connecting the heat-source side heat exchanger and the using side heat exchanger (specifically, an expansion valve of the heat-source side heat exchanger and an expansion valve of the using side heat exchanger), the gas-liquid mixed refrigerant after the heat exchange in the heat source side heat exchanger or the using side heat exchanger is subjected to the gas-liquid separation in the intermediate-pressure receiver, and then the gas-phase refrigerant is led to the intermediate-pressure portion of the compressor.

In the above refrigerating machine, the intermediate-pressure receiver has a receiver main body including a first inlet/outlet pipe, a second inlet/outlet pipe and a gas outlet pipe, the gas-liquid mixed refrigerant is injected into any one of the first inlet/outlet pipe and the second inlet/outlet pipe while liquid-phase refrigerant after the gas-liquid separation is discharged from the other inlet/outlet pipe, and the gas-phase refrigerant is discharged from the gas outlet pipe.

In the above refrigerating machine, the inside of the high-pressure pipe connected to the refrigerant discharge pipe is operated under super critical pressure during an operation of the refrigerating machine.

In the above refrigerating machine, carbon dioxide refrigerant is used as the refrigerant.

The above refrigerating machine may further comprise a thermal storage unit using water as a thermal storage medium that is provided as one of the using side heat exchangers between the high-pressure pipe and the intermediate-pressure pipe.

According to second aspect of the present invention, there is provided an intermediate-pressure receiver comprising: a receiver main body in which gas-liquid separation of refrigerant is carried out; a first inlet/outlet pipe and a second inlet/outlet pipe provided to the receiver main body, gas-liquid mixed refrigerant being injected through any one of the first and second inlet/outlet pipes into the receiver main body while liquid-phase refrigerant after the gas-liquid separation is discharged from the other inlet/outlet pipe; and a gas outlet pipe provided to the receiver main body, gas-phase refrigerant after the gas-liquid separation being discharged from the gas outlet pipe.

In the above intermediate-pressure receiver, one end of the gas outlet pipe is opened at the upper portion of the receiver main body, and one end of the first inlet/outlet pipe and one end of the second inlet/outlet pipe are opened at the lower portion of the receiver main body.

In the above intermediate-pressure receiver, the receiver main body has a substantially cylindrical hollow shape.

In the above intermediate-pressure receiver, the first inlet/outlet pipe and the second inlet/outlet pipe are disposed so as to be displaced from each other with respect to the radial direction of the receiver main body.

In the above intermediate-pressure receiver, the first inlet/outlet pipe and the second inlet/outlet pipe are designed so that one ends thereof are projected into the inside of the receiver main body and bent so as to be displaced from each other with respect to the radial direction of the receiver main body.

In the above intermediate-pressure receiver, the opening end of the first inlet/outlet pipe and the opening end of the second inlet/outlet pipe are disposed so as not to face each other.

The above intermediate-pressure receiver may further comprise a separation promoting member for promoting the gas-liquid separation of the gas-liquid mixed refrigerant.

In the above intermediate-pressure receiver, the separation promoting member comprises a baffle plate or a metal mesh.

In the above intermediate-pressure receiver, the separation promoting member comprises a plate-shaped member that is provided in the receiver main body so as to extend from the bottom surface of the receiver main body to the upper portion of the receiver main body.

In the above intermediate-pressure receiver, the separation promoting member further comprises a disc-shaped member provided above the plate-shaped member in the receiver main body.

In the above intermediate-pressure receiver, the separation promoting member comprises a plurality of disc-shaped members disposed so as to be spaced from one another at predetermined intervals.

In the above intermediate-pressure receiver, the separation promoting member comprises a plurality of annular members disposed so as to be spaced from one another at predetermined intervals.

According to the present invention, even when the amount of a gas-phase component of the refrigerant which does not contribute to the heat-exchange in the evaporation heat exchanger is increased, for example, the temperature of the heat source to be heat-exchanged with the refrigerant in the high-pressure side heat exchanger used a radiator is increased, the performance can be kept or enhanced.

DETAILED DESCRIPTION OF THE PREFERRED EMBODIMENTS

Preferred embodiments according to the present invention will be described hereunder with reference to the accompanying drawings.

Figure 1:
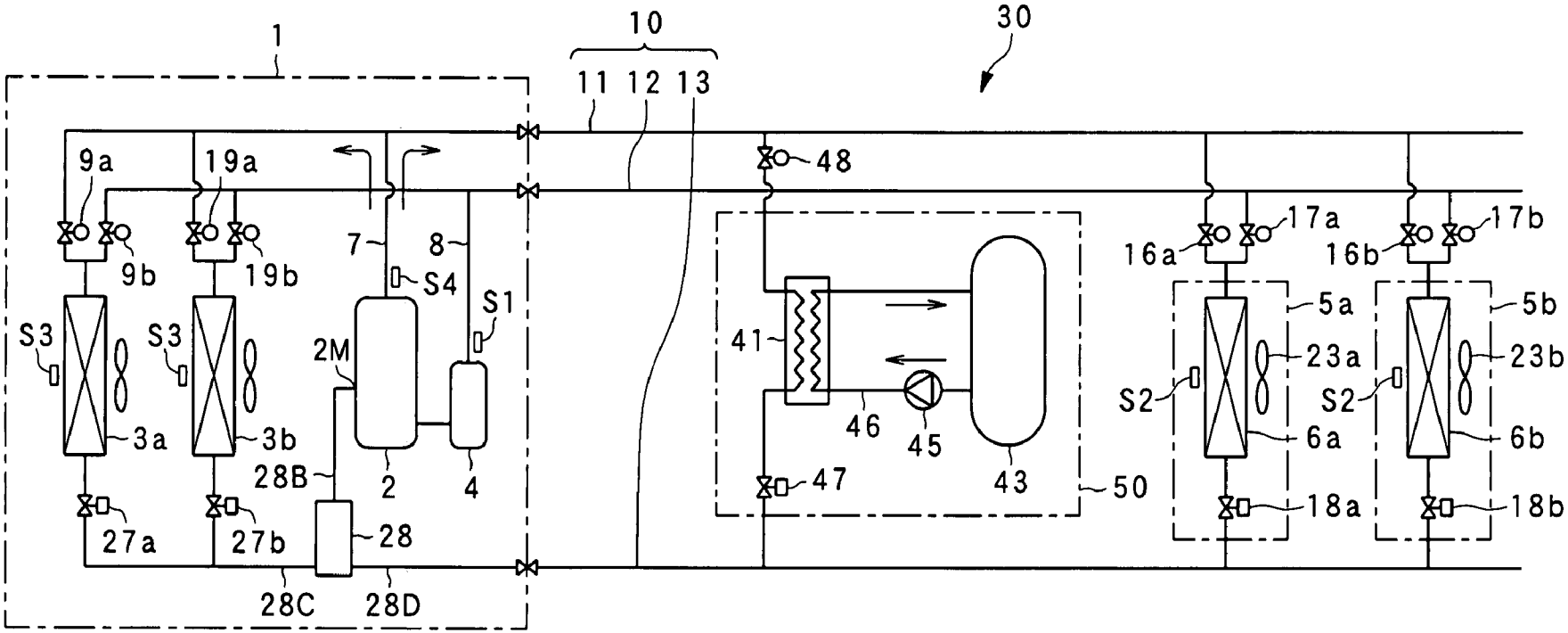
FIG. 1 is a refrigerant circuit diagram showing an embodiment of a refrigerating machine according to the present invention.

FIG. 1 is a refrigerant circuit diagram showing an embodiment of a refrigerating machine according to the present invention.

A refrigerating machine 30 is equipped with an outdoor unit 1 having a compressor 2, outdoor heat exchangers 3*a*, 3*b* and outdoor expansion valves 27*a*, 27*b*, an indoor unit 5*a* having an indoor heat exchanger 6*a* and an indoor expansion valve 18*a*, an indoor unit 5*b* having an indoor heat exchanger 6*b* and an indoor expansion valve 18*b*, and a hot-water supply unit 50 having a hot-water stocking heat exchanger 41, a hot-water stocking tank 43, a circulating pump 45 and an expansion valve 47.

The outdoor unit 1, the indoor units 5*a*, 5*b* and the hot-water supply unit 50 are connected to one another through an inter-unit pipe 10, and the refrigerating machine 30 can carry out cooling operation or heating operation on the indoor units 5*a*, 5*b* at the same time or carry out cooling operation and heating operation on the indoor units 5*a*, 5*b* in a mixture style while driving the hot-water supply unit 50.

In the outdoor unit 1, one end of the outdoor heat exchanger 3*a* is exclusively connected to the discharge pipe 7 or suction pipe 8 of the compressor 2 through a change-over valve 9*a* or change-over valve 9*b*. Likewise, one end of the outdoor heat exchanger 3*b* is exclusively connected to the discharge pipe 7 or suction pipe 8 of the compressor 2 through change-over valves 19*a*, 19*b*. An accumulator 4 is disposed in the suction pipe 8.

The outdoor unit 1 is equipped with an outdoor control device (not shown), and the outdoor control device controls the compressor 2, the outdoor expansion valves 27*a*, 27*b* and the change-over valves 9*a*, 19*a*, 9*b*, 19*b* in the outdoor unit 1 and the whole of the refrigerating machine 30.

Furthermore, the refrigerating machine 30 is equipped with a temperature sensor S1 for detecting the refrigerant temperature at the entrance of the accumulator 4, a temperature sensor S2 for detecting the refrigerant temperature of the indoor heat exchangers 6*a*, 6*b*, a temperature sensor S3 for detecting the refrigerant temperature of the outdoor heat exchangers 3*a*, 3*b*, and a temperature sensor S4 for detecting the refrigerant temperature at the exit of the compressor 2.

Figure 2:
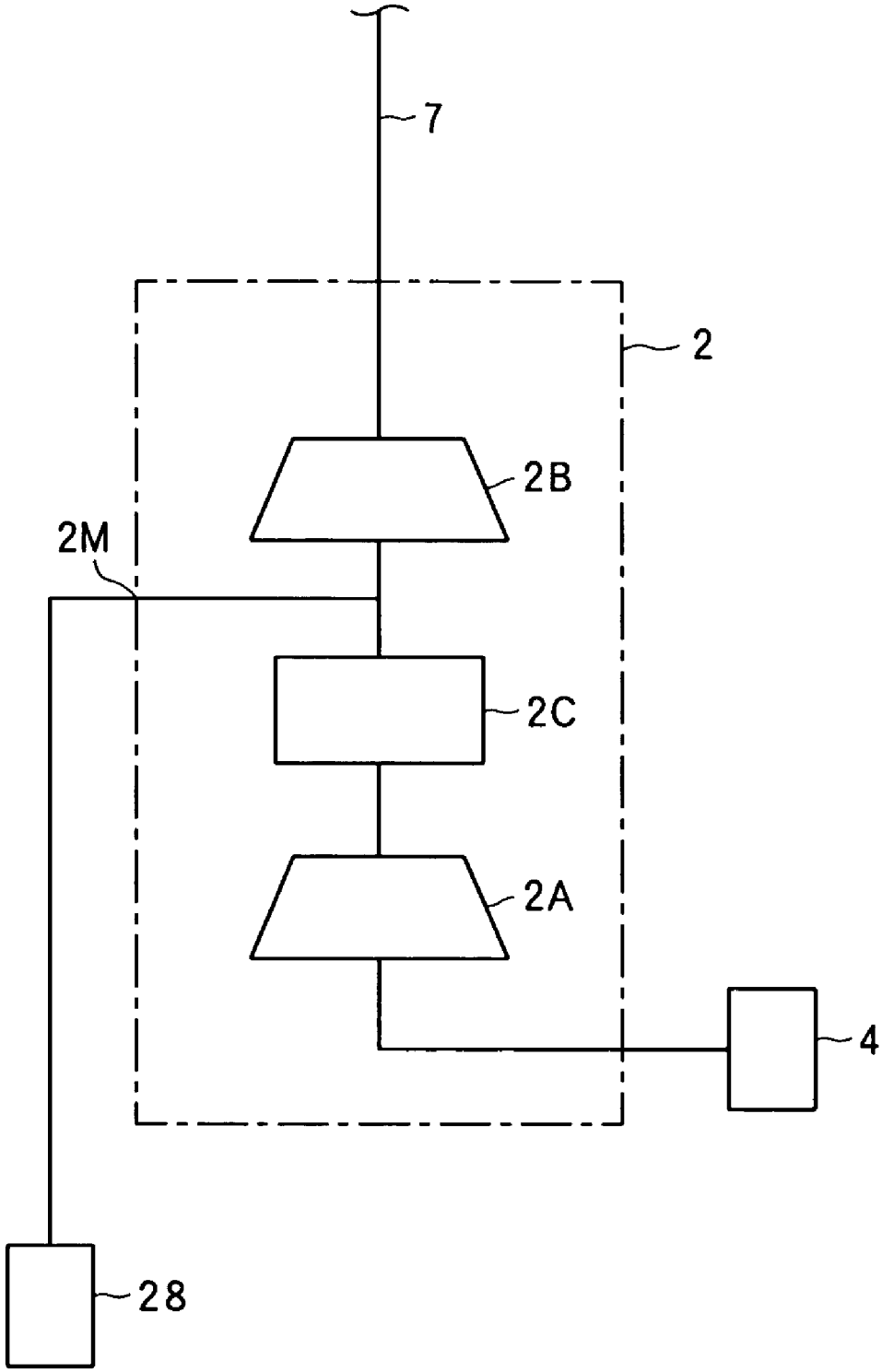
FIG. 2 is a block diagram showing the construction of a compressor.

FIG. 2 is a block diagram showing the construction of the compressor.

The compressor 2 is a two-stage compressor, and it comprise a first-stage compressing unit 2A for compressing refrigerant at the low-pressure suction side, a second-stage compressing unit 2B for compressing refrigerant at the high-pressure discharge side, and an intermediate cooler 2C for cooling the refrigerant discharged from the first-stage compressing unit 2A and outputting the refrigerant thus cooled to the second-stage compressing unit 2B side. An intermediate pressure portion which can introduce refrigerant from the external is provided at the intermediate portion between the second-stage compressing unit (high-pressure discharge side) 2B and the intermediate cooler 2C.

The inter-unit pipe 10 is equipped with a high-pressure pipe (high-pressure gas pipe) 11, a low-pressure pipe (low-pressure gas pipe) 12 and an intermediate-pressure pipe (liquid pipe) 13. The high-pressure pipe 11 is connected to the discharge pipe 7, and the low-pressure pipe 12 is connected to the suction pipe 8. The intermediate-pressure pipe 13 is connected through the outdoor expansion valves 27*a*, 27*b* to the other ends of the outdoor heat exchangers 3*a*, 3*b*.

The intermediate-pressure receiver (gas-liquid separator) 28 is connected between the intermediate-pressure pipe 13 and the outdoor expansion valves 27*a*, 27*b*, and a gas outlet pipe 28B of the intermediate-pressure receiver 28 is connected to the intermediate-pressure portion 2M of the compressor 2, so that gas-phase refrigerant is introduced from the gas outlet pipe 28B into the compressor 2. The intermediate-pressure receiver 28 is designed as a bi-directional type gas-liquid separating device into which refrigerant can flow from both the outdoor heat exchanger 3*a*, 3*b* side and the indoor heat exchanger 6*a*, 6*b* side.

Figure 3:
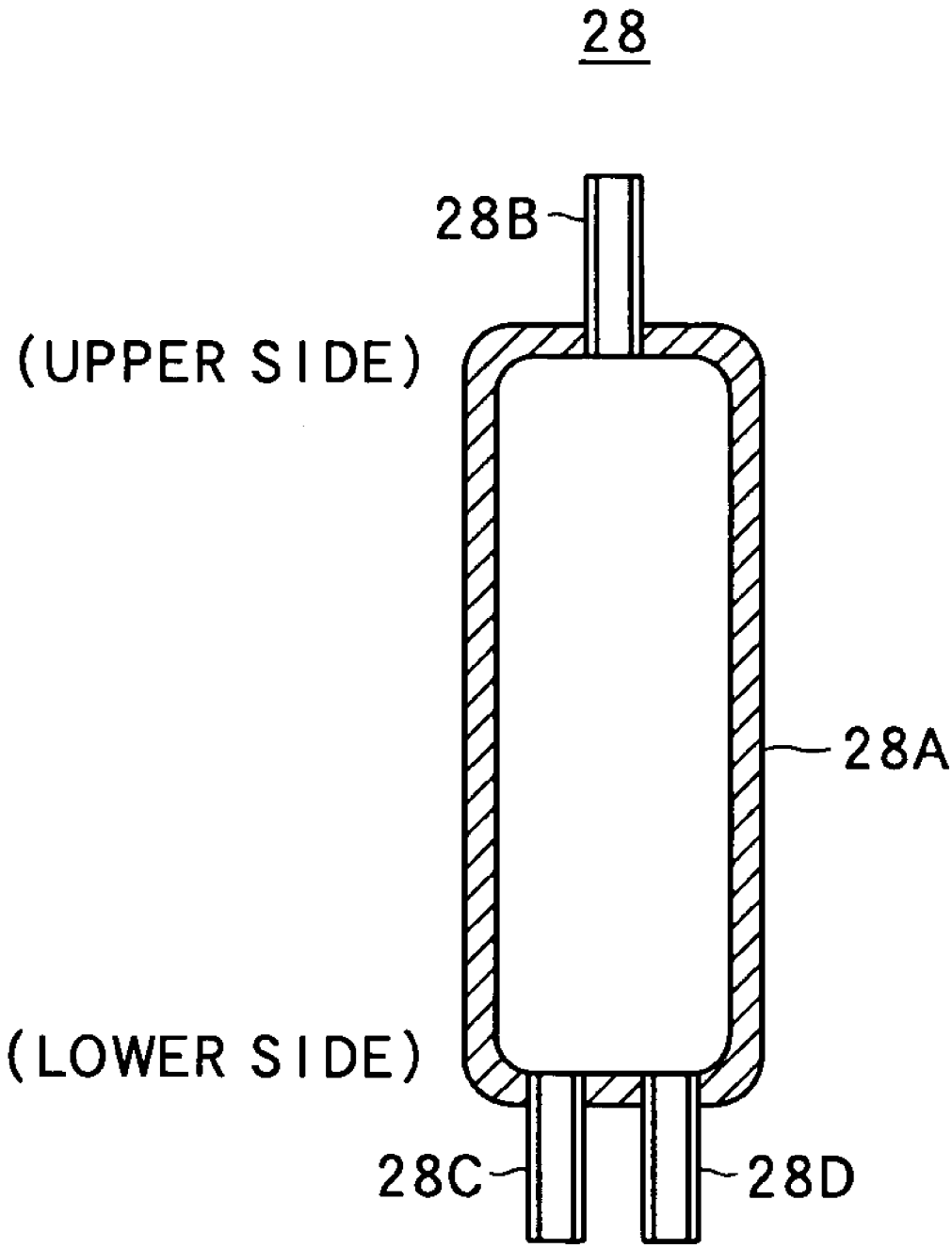
FIG. 3 is a diagram showing an intermediate-pressure receiver according to an embodiment of the present invention.

FIG. 3 is a diagram showing the construction of the intermediate receiver according to this embodiment.

Here, the specific construction of the intermediate-pressure receiver 28 will be described.

The intermediate-pressure receiver 28 mainly comprises a receiver main body 28A, the gas outlet pipe 28B, a first inlet/outlet pipe 28C and a second inlet/outlet pipe 28D.

The receiver main body 28A is designed as a hollow body having a substantially cylindrical outlook. A suction port (opening end) of the gas outlet pipe 28B is provided at the center of the top surface at the upper side of the receiver main body 28A so as to face the inside of the receiver main body 28A. Furthermore, a first inlet/outlet pipe 28C and a second inlet/outlet pipe 28D are substantially vertically disposed on the bottom surface of the receiver main body 28A so that the opening end of the first inlet/outlet port pipe 28C and the opening end of the second inlet/outlet pipe 28D are located symmetrically wit each other.

In this case, in accordance with the flow direction of the refrigerant in the intermediate pressure pipe 13, any one pipe of the first inlet/outlet pipe 28C and the second inlet/outlet pipe 28D functions as an inlet pipe into which gas-liquid mixture refrigerant flows and the other pipe functions as a liquid outlet pipe from which liquid refrigerant after gas-liquid separation flows out. In FIG. 3, the opening ends (discharge port or suction port) of the first inlet/outlet pipe 28C and the second inlet/outlet pipe 28D are illustrated as being coincident with the bottom surface of the receiver main body 28A. However, they may be located at any height of the lower side of the receiver main body 28A so as to be spaced from the bottom surface of the receiver main body 28A by a predetermined distance or more so that they are located at the same height and liquid refrigerant is not sucked into the gas outlet pipe 28B.

One ends of the indoor heat exchangers 6*a*, 6*b* of the indoor units 5*a*, 5*b* are connected to the high-pressure pipe 11 through the discharge side valves 16*a*, 16*b*, and also connected to the lower-pressure pipe 12 through the suction side valves 17*a*, 17B. The other ends thereof are connected to the intermediate pressure pipe 13 through the indoor expansion valves 18*a*, 18*b*.

The discharge side valve 16*a* and the suction side valve 17*a* are operated so that when one valve is opened, the other valve is closed. Likewise, the discharge side valve 16*b* and the suction side valve 17*b* are operated so that when one valve is opened, the other valve is closed.

Accordingly, one ends of the indoor heat exchangers 6*a*, 6*b* are selectively connected to the high-pressure pipe 11 and the low-pressure pipe 12 of the inter-unit pipe 10.

Each of the indoor units 5*a*, 5*b* is further equipped with indoor fans 23*a*, 23*b*, a remote controller and an indoor control device. The respective indoor fans 23*a*, 23*b* is located in the vicinity of the indoor heat exchangers 6*a*, 6*b* respectively, and blow air to the respective indoor heat exchangers 6*a*, 6*b*. Each remote controller is connected to each indoor unit 5*a*, 5*b*, and outputs a cooling or heating operation instruction, a stop instruction or the like to the corresponding indoor unit 5*a*, 5*b*.

In the hot-water stocking unit 50, one end of the hot-water stocking heat exchanger 41 is connected to the high-pressure pipe 11 through a switching valve 48, and the other end of the hot-water stocking heat exchanger 41 is connected to the intermediate pressure pipe 13 through the expansion valve 47. A water pipe 46 is connected to the hot-water stocking heat exchanger 41, and the hot-water stocking tank 43 is connected through a circulating pump 45 to the water pipe 46.

In this embodiment, carbon dioxide refrigerant is sealingly filled in the outdoor unit 1, the indoor units 5*a*, 5*b*, the pipes in the hot-water stocking unit 50 and the inter-unit pipe 10.

Figure 4:
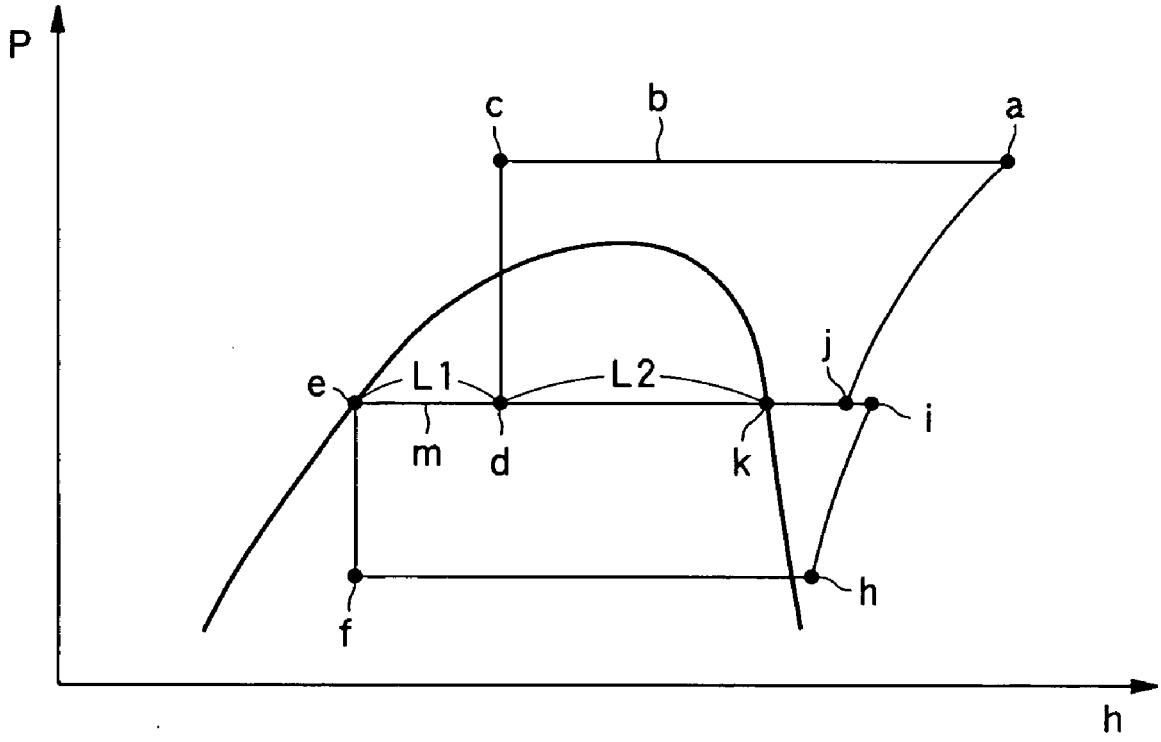
FIG. 4 is a pressure-enthalpy chart.

FIG. 4 is a pressure-enthalpy chart.

When carbon dioxide is sealingly filled, the inside of the high-pressure pipe 11 is operated under super critical pressure during operation as shown in FIG. 4.

For example, in addition to carbon dioxide refrigerant, ethylene, diborane, ethane, nitrogen oxide, etc. are known as refrigerant with which the inside of the high-pressure pipe 11 is operated under supercritical pressure.

In FIG. 4, the state of the refrigerant at the exit of the compressor 2 is indicated by a state a. The refrigerant is circulated through the heat exchanger and cooled there until the state a shifts to a state c, thereby radiating heat to cooling air. Then, the refrigerant is reduced in pressure by the expansion valve serving as a pressure-reducing device to shift the state c to a state d. In this state d, two-phase mixture refrigerant of gas-phase/liquid-phase is formed and reaches the intermediate-pressure receiver 28.

In the intermediate-pressure receiver 28, the refrigerant is subjected to gas-liquid separation. The gas-phase part of the refrigerant is set to a state k in the intermediate-pressure receiver, and then returned to the second-stage compressing portion 2B of the compressor 2. The state j is a state at the entrance of the second-stage compressing portion 2B.

On the other hand, a liquid-phase part of the refrigerant is set to a state e in the intermediate-pressure receiver 28. The liquid-phase part of the refrigerant is reduced in pressure by the expansion valve serving as a pressure-reducing device and thus the state thereof reaches a state f. Furthermore, the liquid-phase part of the refrigerant evaporates in the evaporator to absorb heat. Here, a state h is a state at the exit of the evaporator, that is, the entrance of the first-stage compressing portion 2A of the compressor 2, and a state i is a state at the exit of the first-stage compressing portion 2A of the compressor 2.

In the above supercritical cycle, the high-pressure gas-phase refrigerant discharged from the compressor 2 is not condensed, however, reduction of the temperature occurs in the heat exchanger. The high-pressure gas-phase refrigerant is cooled till the state c which is higher than the temperature of the cooling air by several degrees.

Next, the operation of the refrigerating machine 30 will be described.

Cooling Operation

First, the operation under cooling operation will be described.

When cooling operation is carried out in the indoor units 5*a*, 5*b*, one change-over valves 9*a*, 19*a* of the outdoor heat exchangers 3*a*, 3*b* are opened while the other change-over valves 9*b*, 19*b* are closed. In addition, the discharge side valves 16*a*, 16*b* are closed and the suction side valves 17*a*, 17*b* are opened. Furthermore, the outdoor fans 29*a*, 29*b*, the indoor fans 23*a*, 23*b* and the compressor 2 are set to the driving state, and the circulating pump 45 is set to the stop state.

In this case, the opening degrees of the outdoor expansion valves 27*a*, 27*b* and the indoor expansion valves 18*a*, 18*b* are controlled so that the temperature sensor S4 detects a predetermined temperature and the difference between the detection temperature of the temperature sensor S1 and the detection temperature of the temperature sensor S2 (=corresponding to superheat degree) is equal to a fixed value.

The refrigerant discharged from the compressor 2 successively flows through the discharge pipe 7, the change-over valves 9*a*, 19*a* and the outdoor heat exchangers 3*a*, 3*b* in this order.

After the refrigerant is subjected heat exchange in the outdoor heat exchangers 3*a*, 3*b*, the refrigerant is reduced in pressure in the outdoor expansion valves 27*a*, 27*b* and then reaches the first inlet/outlet pipe (=functioning as an inlet pipe) of the intermediate-pressure receiver 28, and then the refrigerant is subjected to gas-liquid separation in the receiver main body 28A.

As a result, the gas-phase refrigerant is supplied through the gas outlet pipe 28B to the intermediate pressure portion 2M of the compressor 2, and compressed in the compressor 2.

The liquid-phase refrigerant flows through the second inlet/outlet port pipe 28D into the intermediate-pressure pipe 13, and is distributed to the indoor expansion valves 18*a*, 18*b* of the indoor units 5*a*, 5*b* to be reduced in pressure.

Thereafter, the refrigerant is evaporated in the indoor heat exchangers 6*a*, 6*b*, flows through the suction side valves 17*a*, 17*b*, and then successively passes through the low-pressure pipe 12, the suction pipe 8 and the accumulator 4. Finally, the refrigerant is sucked into the compressor 2. As described above, all the indoor units 5*a*, 5*b* carry out cooling operation simultaneously by the action of the indoor heat exchangers 6*a*, 6*b* functioning as the evaporators.

Heating Operation

Next, the operation of the heating operation will be described.

When heating is carried out in the indoor units 5*a*, 5*b*, one change-over valves 9*a*, 19*a* of the outdoor heat exchangers 3*a*, 3*b* are closed while the other change-over valves 9*b*, 19*b* are opened. In addition, the discharge side valves 16*a*, 16*b* are opened while the suction side valves 17*a*, 17*b* are closed.

In this case, the opening degrees of the outdoor expansion valves 27*a*, 27*b* and the indoor expansion valves 18*a*, 18*b* are controlled so that the temperature sensor S4 detects a predetermined temperature and also the difference between the detection temperature of the temperature sensor s1 and the detection temperature of the temperature sensor S3 (=corresponding to superheat degree) is equal to a fixed value.

Accordingly, the refrigerant discharged from the compressor 2 successively passes through the discharge pipe 7 and the high-pressure pipe 11 and flows into the discharge side valves 16*a*, 16*b* and the indoor heat exchangers 6*a*, 6*b*. The refrigerant is not condensed and heat-exchanged in the indoor heat exchangers 6*a*, 6*b*, and reduced in pressure by the indoor expansion valves 18*a*, 18*b*. The refrigerant thus pressure-reduced reaches the second inlet/output pipe 28D (=functions as an inlet pipe) through the intermediate pressure pipe 13, and subjected to gas-liquid separation in the receiver main body 28A.

As a result, the gas-phase refrigerant is supplied through the gas outlet pipe 28B into the intermediate pressure portion 2M of the compressor 2, and compressed by the compressor 2.

The liquid-phase refrigerant is distributed through the first inlet/outlet pipe 28C (functioning as the liquid outlet pipe) to the indoor expansion valves 27*a*, 27*b* of the respective outdoor units 3*a*, 3*b*, and reduced in pressure there. Thereafter, the liquid-phase refrigerant is evaporated in the respective outdoor heat exchangers 3*a*, 3*b*, flows through the change-over valves 9*b*, 19*b* and successively passes through the low-pressure pipe 12, the suction pipe 8 and the accumulator 4, and finally it is sucked into the compressor 2.

As described above, all the indoor units 5*a*, 5*b* carry out heating operation simultaneously by the non-condensation heat-exchange action of the indoor heat exchangers 6*a*, 6*b*.

Cooling/Heating Mixed Operation (Part 1)

Next, the operation under cooling/heating mixed operation will be described.

When cooling operation and heating operation are simultaneously carried out in different indoor units, for example when the cooling operation is carried out in the indoor unit 5*a* and the heating operation is carried out in the indoor unit 5*b*, if a cooling load is larger than a heating load, one change-over valves 9*a*, 19*a* of the outdoor heat exchangers 3*a*, 3*b* are opened while the other change-over valves 9*b*, 19*b* are closed. Furthermore, the discharge side valve 16*a* corresponding to the indoor unit 5*a* which should carry out cooling operation is closed, and the suction side valve 17*a* is opened. Furthermore, the discharge side valve 16*b* corresponding to the indoor unit 5*b* which should heating operation is opened while the suction side valve is closed.

As a result, a part of the refrigerant discharged from the compressor 2 successively passes the discharge pipe 7 and the change-over valves 9*a*, 19*a* and flows into the outdoor heat exchanger 3. In addition, the remaining refrigerant passes through the high-pressure pipe 11 and flows into the discharge side valve 16*b* and the outdoor heat exchanger 6*b* of the indoor unit 5*b* which should carry out heating operation, so that non-condensation heat exchange action is carried out in the indoor heat exchanger 6*b* and the outdoor heat exchanger 3.

The refrigerant heat-exchanged in the indoor heat exchanger 6*b*, the outdoor heat exchanger 3 passes through the intermediate-pressure pipe 13, and it is reduced in pressure by the indoor expansion valve 18*a* of the indoor unit 5*a*, and then evaporated in the indoor heat exchanger 6*a*. Thereafter, the refrigerant flows through the suction side valve 17*a* and is confluent in the low-pressure pipe 12. The confluent refrigerant successively passes through the suction pipe 8 and the accumulator 4 and then is sucked into the compressor 2. As described above, the indoor unit 5*b* carries out heating operation by the heat exchange action of the indoor heat exchanger 6*b*, and the indoor unit 5*a* carries out cooling operation by the action of the other indoor heat exchanger 6*a* functioning as an evaporator.

Cooling/Heating Mixed Operation (Part 2)

Next, the other operation under cooling/heating mixed operation will be described.

When heating operation is carried out by the indoor unit 5*a* while cooling operation is carried out by the indoor unit 5*b* and the heating load is larger than the cooling load, the one change-over valves 9*a*, 19*a* of the outdoor heat exchanger 3 are closed while the other change-over valves 9*b*, 19*b* are opened, the discharge side valve 16*b* corresponding to the indoor unit 5*b* which caries out cooling operation is closed while the suction side valve 17*b* is opened, and the discharge side valve 16*a* corresponding to the indoor unit 5*a* carrying out heating operation is opened while the suction side valve 17*a* is closed. In this case, the refrigerant discharged from the compressor 2 is passed through the discharge pipe 7 and the high-pressure pipe 11, and distributed to the discharge side valve 16*a*, and then it is heat-exchanged with no condensation. The refrigerant thus heat-exchanged passes through the indoor expansion valve 18*a*, and flows into the intermediate-pressure pipe 13. A part of the refrigerant in the intermediate-pressure pipe 13 is reduced in pressure by the indoor expansion valve 18*b*, and then evaporated in the indoor heat exchanger 6*b*. Furthermore, the refrigerant thus evaporated flows through the suction side valve 17*b*, successively passes through the low-pressure pipe 12, the suction pipe 8 and the accumulator 4, and then is sucked into the compressor 2. The remaining refrigerant in the intermediate pressure pipe 13 reaches the second inlet/outlet pipe 28D of the intermediate pressure receiver 28 (=functioning as an inlet pipe), and it is subjected to gas-liquid separation in the receiver body 28A.

As a result, the gas-phase refrigerant is supplied through the gas outlet pipe 28B to the intermediate pressure portion 2M of the compressor 2, and compressed in the compressor 2.

Furthermore, the liquid-phase refrigerant is passed through the first inlet/outlet pipe 28C (=functioning as the liquid outlet pipe), reduced in pressure in the outdoor expansion valves 27*a*, 27*b*, and heat-exchanged in the outdoor heat exchangers 3*a*, 3*b*. The refrigerant thus heat-exchanged flows through the suction side valves 9*b*, 19*b*. Thereafter, it is successively passed through the low-pressure pipe 12, the suction pipe 8 and the accumulator 4, and sucked into the compressor 2.

As described above, the indoor unit 5*a* carries out heating operation by the no-condensation heat-exchange action of the indoor heat exchanger 6*a*, and the indoor unit 5*b* carries out cooling operation by the action of the indoor heat exchanger 6*b* functioning as the evaporator.

Cooling+Hot-Water Stocking Operation (Part 1)

Next, a first operation of Cooling+Hot-water Stocking operation will be described.

When the "Cooling+Hot-water Stocking" operation is carried out, the one change-over valves 9*a*, 19*a* of the outdoor heat exchangers 3*a*, 3*b* are opened while the other change-over valves 9*b*, 19*b* are closed. In addition, the discharge side valves 16*a*, 16*b* are closed, and also the suction side valves 17*a*, 17*b* are opened. Furthermore, each of the outdoor fans 29*a*, 29*b*, the indoor fans 23*a*, 23*b* and the compressor 2 is set to a driving state, and the circulating pump 45 is set to a driving state. Furthermore, the switching valve 48 for connecting the high-pressure pipe 11 and the hot-water stocking heat exchanger 41 is opened.

In this case, the opening degrees of the outdoor expansion valves 27*a*, 27*b*, the indoor expansion valves 18*a*, 18*b* and the expansion valve 47 are controlled so that the temperature sensor S4 detects a predetermined temperature and the difference between the detection temperature of the temperature sensor S1 and the detection temperature of the temperature sensor S2 (=corresponding to the superheat degree) is equal to a fixed value.

A part of the refrigerant discharged from the compressor 2 is led through the discharge pipe 7, the high-pressure pipe 11 and the switching valve 48 to the hot-water stocking heat exchanger 41. In the hot-water stocking heat exchanger 41, water passing through the water pipe 46 is heated, and high-temperature water is stocked in the hot-water tank 43. Carbon dioxide is used as the refrigerant, and high-pressure supercritical cycle is established, so that the temperature of hot water thus stocked is increased to a high temperature above about 80° C. or more. The hot water stocked in the hot-water tank 43 is fed to various kinds of facilities through pipes (not shown) (hot water stocking operation).

The refrigerant thus heat-exchanged is reduced in pressure while passing through the expansion valve 47, and reaches the intermediate pressure pipe 13. Furthermore, the refrigerant is distributed to the indoor expansion valves 18*a*, 18*b* of the indoor units 5*a*, 5*b* to be reduced in pressure again. Then, the refrigerant is evaporated in the indoor heat exchangers 6*a*, 6*b*, flows through the suction side valves 17*a*, 17*b*, successively passes through the low-pressure pipe 12, the suction pipe 8 and the accumulator 4, and then is sucked into the compressor 2.

On the other hand, the other part of the refrigerant discharged from the compressor 2 successively flows through the discharge pipe 7, the change-over valves 9*a*, 19*a* and the outdoor heat exchangers 3*a*, 3*b*.

The refrigerant is heat-exchanged in the outdoor heat exchangers 3*a*, 3*b*, and then reduced in pressure in the outdoor expansion valves 27*a*, 27*b*. Then, the refrigerant thus pressure-reduced reaches the first inlet/outlet pipe 28C of the intermediate pressure receiver 28 (=functioning as an inlet pipe), and is subjected to gas-liquid separation in the receiver main body 28A.

As a result, the gas-phase refrigerant is supplied through the gas outlet pipe 28B to the intermediate pressure portion 2M of the compressor 2, and compressed in the compressor 2. The liquid-phase refrigerant flows through the second inlet/outlet pipe 28D into the intermediate pipe 13, and it is distributed to the indoor expansion valves 18*a*, 18*b* of the indoor units 5*a*, 5*b* and reduced in pressure there. Thereafter, the refrigerant is evaporated in the indoor heat exchangers 6*a*, 6*b*, and it flows into the suction side valves 17*a*, 17*b*. Thereafter, the refrigerant is successively passed through the low-pressure pipe 12, the suction pipe 8 and the accumulator 4, and then sucked in the compressor 2. As described above, all the indoor units 5*a*, 5*b* carry out cooling operation at the same time by the action of the indoor heat exchangers 6*a*, 6*b* functioning as evaporators.

Cooling+Hot-Water Stocking Operation (Part 2)

Next, a second operation under the "Cooling+Hot-water Stocking" operation will be described.

When the "Cooling+Hot-water Stocking" operation is carried out, the change-over valves 9*a*, 19*a*,9*b*, 19*b* of the outdoor heat exchangers 3*a*, 3*b* are closed. In addition, the discharge side valves 16*a*, 16*b* are closed, and the suction side valves 17*a*, 17*b* are opened. The outdoor fans 29*a*, 29*b* are set to the stop state, the indoor fans 23*a*, 23*b* are set to the driving state, and the circulating pump 45 is set to the driving state. Furthermore, the switching valve 48 for connecting the high-pressure pipe 11 and the hot-water stocking heat exchanger 41 is opened.

When the compressor 2 is driven under this state, the refrigerant discharged from the compressor 2 is led through the discharge pipe 7, the high-pressure pipe 11 and the switching valve 48 to the hot-water stocking heat exchanger 41. In the hot-water stocking heat exchanger 41, water passing through the water pipe 46 is heated, and high-temperature water is stocked in the hot-water stocking tank 43. Carbon dioxide refrigerant is used as the refrigerant, and the high-pressure supercritical cycle is established, so that the hot water thus stocked has a high temperature of about 80° C. or more. The hot water stocked in the hot-water stocking tank 43 is fed to various kinds of facilities through pipes (not shown) (hot water stocking operation).

The refrigerant heat-exchanged is reduced in pressure through the expansion valve 47, and fed to the intermediate pressure pipe 13. Then, the refrigerant is distributed to the indoor expansion valves 18*a*, 18*b* of the indoor units 5*a*, 5*b* and reduced in pressure again. Furthermore, the refrigerant is evaporated in the indoor heat exchangers 6*a*, 6*b*, flows through the suction side valves 17*a*, 17*b*, successively passes through the low-pressure pipe 12, the suction pipe 8 and the accumulator 4, and then is sucked into the compressor 2.

Hot-Water Stocking Operation

Next, the operation under Hot-water Stocking Operation will be described.

When the hot-water stocking operation is carried out, the one change-over valves 9*a*, 19*a* of the outdoor heat exchangers 3*a*, 3*b* are closed while the other change-over valves 9*b*, 19*b* are opened. In addition, the discharge side valves 16*a*, 16*b* and the suction side valves 17*a*, 17*b* are closed. Furthermore, the outdoor fans 29*a*, 29*b* are set to the driving state, the indoor fans 23*a*, 23*b* are stopped, and the circulating pump 45 is set to the driving state. Furthermore, the switching valve 48 for connecting the high-pressure pipe 11 and the hot-water stocking heat exchanger 41 is opened.

When the compressor 2 is driven under this state, the refrigerant discharged from the compressor 2 is led through the discharge pipe 7, the high-pressure pipe 11 and the switching valve 48 to the hot-water stocking heat exchanger 41. In the hot-water stocking heat exchanger 41, water passing through the water pipe 46 is heated, and high-temperature water is stocked in the hot-water stocking tank 43. Carbon dioxide refrigerant is used as the refrigerant, and the high-pressure supercritical cycle is established, so that the hot water thus stocked is set to a high temperature of about 80° C. or more. The hot water stocked in the hot-water stocking tank 43 is fed to various kinds of facilities through pipes (not shown) (hot water stocking operation).

The heat-exchanged refrigerant is reduced in pressure through the expansion valve 47, fed to the intermediate-pressure pipe 13, and further fed to the second inlet/outlet pipe 28D of the intermediate-pressure receiver 28 (=functioning as an inlet pipe). Furthermore, the refrigerant is passed through the receiver main body 28A, distributed to the indoor expansion valves 27*a*, 27*b* of the outdoor units 3*a*, 3*b* through the first inlet/outlet pipe 28C, and reduced in pressure there.

Thereafter, the liquid-phase refrigerant is evaporated in the outdoor heat exchangers 3*a*, 3*b*, and it flows to the suction side valves 9*b*, 19*b*, and it successively passes through the suction side valves 9*b*, 19*b*, the low-pressure pipe 12, the suction pipe 8 and the accumulator 4. Then, it is sucked into the compressor 2.

The ratio between the gas-phase component and the liquid-phase component of the refrigerant before the refrigerant enters the intermediate pressure receiver 28 corresponds to the ratio between L1 (gas-phase component) and L2 (liquid-phase component) in FIG. 4.

Accordingly, when the temperature at the exit of the radiation side heat exchanger increases, the amount of the gas-phase component of the refrigerant before the refrigerant enters the intermediate-pressure receiver 28 is increased, and the amount of the gas-phase refrigerant introduced into the intermediate pressure portion 2M of the compressor 2 is increased. Therefore, the efficiency of the refrigerating cycle is enhanced because the gas-phase component which does not contribute to the cooling operation is not circulated into the low-pressure circuit subsequent to the intermediate-pressure pipe 13. Particularly, in this construction, carbon dioxide is filled in the refrigerating circuit, and thus with respect to the ratio between the gas-phase component and the liquid-phase component separated in the intermediate-pressure receiver 28, the amount of the gas-phase component is larger as compared with conventional freon type refrigerant (chlorofluorocarbon or the like). Therefore, the efficiency can be more enhanced by introducing a larger amount of the gas-phase component into the intermediate pressure portion 2M.

Furthermore, as described above, when cooling operation and heating operation are mixed with each other (when one indoor unit carries out cooling operation and the other indoor unit carries out heating operation, or the like), or when hot-water stocking operation is carried out, the refrigerant is circulated so that the indoor heat exchanger, the outdoor heat exchanger and the hot-water stocking heat exchanger are thermally balanced with one another. According to this thermally-balanced circulation of the refrigerant, the operation can be performed by efficiently using the heat of the indoor and the heat of the outside. Particularly, when the cooling operation of the indoor unit and the hot-water stocking operation are mixed with each other, the hot-water stocking operation (hot-water supply operation) can be performed by using the heat of the indoor, and thus the heat can be remarkably efficiently used. Therefore, occurrence of a so-called heat island phenomenon caused by radiation heat of the outdoor unit can be suppressed to the minimum level.

In the following description, various modifications of the intermediate-pressure receiver 28 will be described.

First Modification

Figure 5:
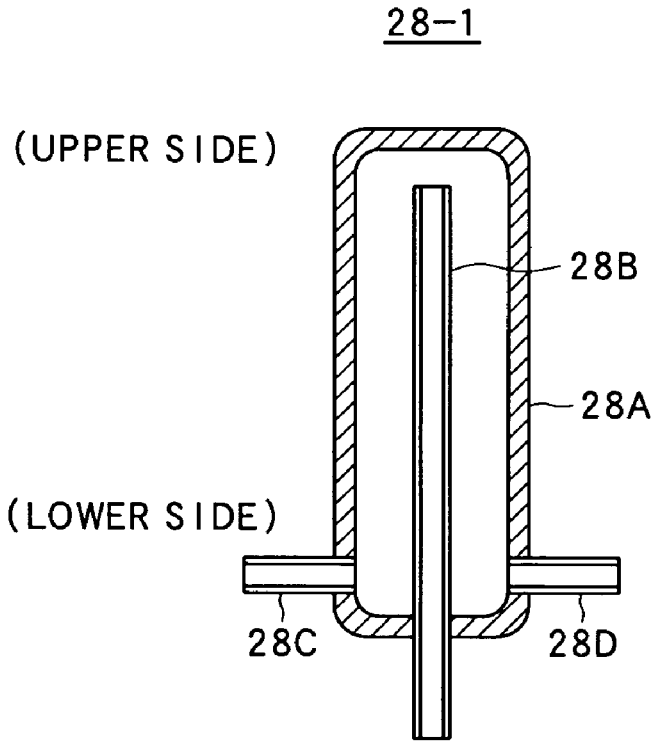
FIG. 5 is a diagram showing the construction of a first modification of the intermediate-pressure receiver.

FIG. 5 is a diagram showing a first modification of the intermediate-pressure receiver. In FIG. 5, the parts having the same functions as the intermediate-pressure receiver of FIG. 3 are represented by the same reference numerals.

An intermediate-pressure receiver 28-1 is mainly equipped with a receiver main body 28A, a gas outlet pipe 28B, a first inlet/outlet pipe 28C and a second inlet/outlet pipe 28D.

The receiver main body 28A is designed as a hollow member having a substantially cylindrical outlook. The gas outlet pipe 28B is formed so as to extend erectly from the bottom surface to the upper portion of the receiver main body, and the opening end of the gas outlet pipe 28B is located at the upper portion of the receiver main body 28A. Furthermore, the opening end of the first inlet/outlet pipe and the opening end of the second inlet/outlet pipe 28D are disposed on the side surface of the lower portion of the receiver main body 28A so as to be substantially vertical to the side wall of the receiver main body 28A and symmetrical with each other with respect to the gas outlet pipe 28B.

In this case, in accordance with the flow direction of the refrigerant in the intermediate-pressure pipe 13, any one of the first inlet/outlet pipe 28C and the second inlet/outlet pipe 28D functions as an inlet pipe in which the gas-liquid mixture refrigerant flows while the other pipe functions as a liquid outlet pipe from which the liquid-refrigerant flows after gas-liquid separation. In FIG. 5, the opening ends of the first inlet/outlet pipe 28C and the second inlet/outlet pipe 28D (the discharge port or the suction port) are illustrated as being near to the bottom surface of the receiver main body 28A, however, the opening ends (discharge port or suction port) of the first inlet/outlet pipe 28C and the second inlet/outlet pipe 28D may be located at any height of the lower portion of the receiver main body 28A so as to be spaced from the opening end of the gas outlet pipe 28B by a predetermined distance or more so that the liquid refrigerant is not sucked into the gas outlet pipe 28B. Furthermore, it is preferable that they are located at the same height, however, it is unnecessary that they are located at the same height.

Second Modification

Figure 6:
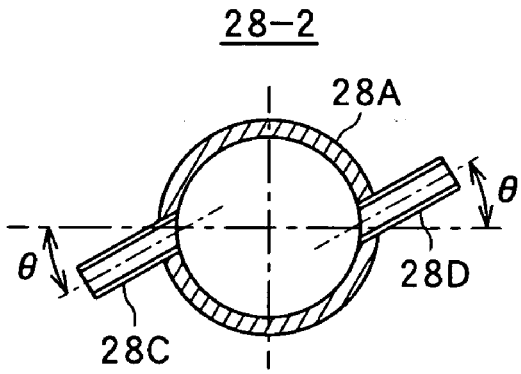
FIG. 6 is a diagram showing the construction of a second modification of the intermediate-pressure receiver.

FIG. 6 is a cross-sectional view showing the first inlet/outlet pipe and the second inlet/outlet pipe of a second modification of the intermediate-pressure receiver, which is viewed from the upper side. In FIG. 6, the parts having the same functions as the intermediate-pressure receiver of FIG. 3 are represented by the same reference numerals.

An intermediate-pressure receiver 28-2 is designed so that the first inlet/outlet pipe 28C and the second inlet/outlet pipe 28D are displaced from each other by an angle θ with respect to the radial direction of the receiver main body 28A and thus the opening end of the first inlet/outlet pipe 28C and the opening end of the second inlet/outlet pipe 28D are not confront to each other.

In this case, in accordance with the flow direction of the refrigerant in the intermediate-pressure pipe 13, any one of the first inlet/outlet pipe 28C and the second inlet/outlet pipe 28D also functions as an inlet pipe in which the gas-liquid mixture refrigerant flows while the other pipe functions as a liquid outlet pipe from which liquid refrigerant flows out after gas-liquid separation. The opening ends (discharge port or suction port) of the first inlet/outlet pipe 28C and the second inlet/outlet pipe 28D may be located at any height of the lower portion of the receiver main body 28A so as to be spaced from the opening end of the gas outlet pipe 28B by a predetermined distance or more so that the liquid refrigerant is not sucked into the gas outlet pipe 28B. Furthermore, it is preferable that they are located at the same height, however, it is unnecessary that they are located at the same height.

Third Modification

Figure 7:
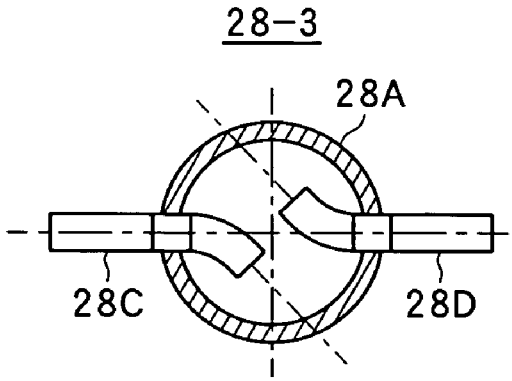
FIG. 7 is a diagram showing the construction of a third modification of the intermediate-pressure receiver.

FIG. 7 is a cross-sectional view of the first inlet/outlet pipe and the second inlet/outlet pipe of a third modification of the intermediate-pressure receiver. In FIG. 7, the parts having the same functions as the intermediate-pressure receiver of FIG. 3 are represented by the same reference numerals.

An intermediate-pressure receiver 28-3 is designed so that the first inlet/outlet pipe 28C and the second inlet/outlet pipe 28D are projected into the receiver main body and bent in different directions so as not to face each other.

In this case, in accordance with the flow direction of the refrigerant in the intermediate-pressure pipe 13, any one of the first inlet/outlet pipe 28C and the second inlet/outlet pipe 28D also functions as an inlet pipe in which the gas-liquid mixture refrigerant flows while the other pipe functions as a liquid outlet pipe from which liquid refrigerant flows out after gas-liquid separation. The opening ends (discharge port or suction port) of the first inlet/outlet pipe 28C and the second inlet/outlet pipe 28D may be located at any height of the lower portion of the receiver main body 28A so as to be spaced from the opening end of the gas outlet pipe 28B by a predetermined distance or more so that the liquid refrigerant is not sucked into the gas outlet pipe 28B. Furthermore, it is preferable that they are located at the same height, however, it is unnecessary that they are located at the same height.

Fourth Modification

Figure 8:
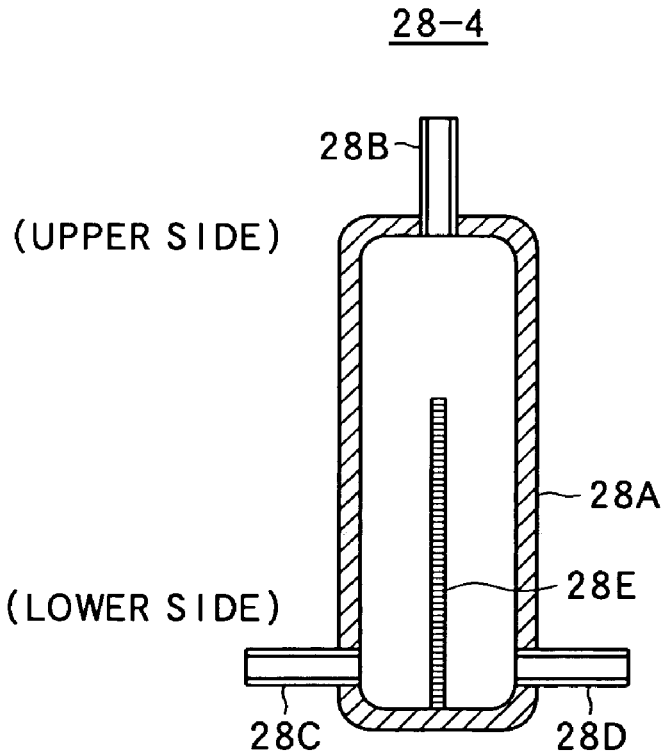
FIG. 8 is a diagram showing the construction of a fourth modification of the intermediate-pressure receiver.

FIG. 8 is a diagram showing a fourth modification of the intermediate-pressure receiver. In FIG. 8, the parts having the functions as the intermediate-pressure receiver of FIG. 3 are represented by the same reference numerals.

An intermediate-pressure receiver 28-4 is mainly equipped with a receiver main body 28A, a gas outlet pipe 28B, a first inlet/outlet pipe 28C, a second inlet/outlet pipe 28D and a separation promoting member 28E for promoting gas-liquid separation.

The receiver main body 28A is formed as a hollow member having a substantially cylindrical outlook. A suction port (opening end) of the gas outlet pipe 28B is formed at the center of the top surface at the upper portion side of the receiver main body 28A so as to face the inside of the receiver main body 28A. Furthermore, a plate-shaped separation promoting member 28E is formed so as to extend erectly from the bottom surface to the upper portion of the receiver main body 28A. The separation promoting member 28E comprises a perforated board (baffle plate), a metal mesh or the like, and the gas-liquid mixture refrigerant injected from the first inlet/outlet pipe 28C or the second inlet/outlet pipe 28D energetically impinges against the separation promoting member 28E to promote the gas-liquid separation.

Furthermore, the opening end of the first inlet/outlet pipe 28C and the opening end of the second inlet/outlet pipe 28D are located on the side surface of the lower portion of the receiver main body 28A so as to be substantially vertical to the side wall of the receiver main body 28A and symmetrical with each other with respect to the gas outlet pipe 28B.

In this case, in accordance with the flow direction of the refrigerant in the intermediate-pressure pipe 13, any one of the first inlet/outlet pipe 28C and the second inlet/outlet pipe 28D also functions as an inlet pipe in which the gas-liquid mixture refrigerant flows while the other pipe functions as a liquid outlet pipe from which liquid refrigerant flows out after gas-liquid separation. In FIG. 8, the opening ends (discharge port or suction port) of the first inlet/outlet pipe 28C and the second inlet/outlet pipe 28D are illustrated as being near to the bottom surface of the receiver main body 28A, however, the opening ends (discharge port or suction port) of the first inlet/outlet pipe 28C and the second inlet/outlet pipe 28D may be located at any height of the lower portion of the receiver main body 28A so as to be spaced from the opening end of the gas outlet pipe 28B by a predetermined distance or more so that the liquid refrigerant is not sucked into the gas outlet pipe 28B. Furthermore, it is preferable that they are located at the same height, however, it is unnecessary that they are located at the same height.

Fifth Embodiment

Figure 9:
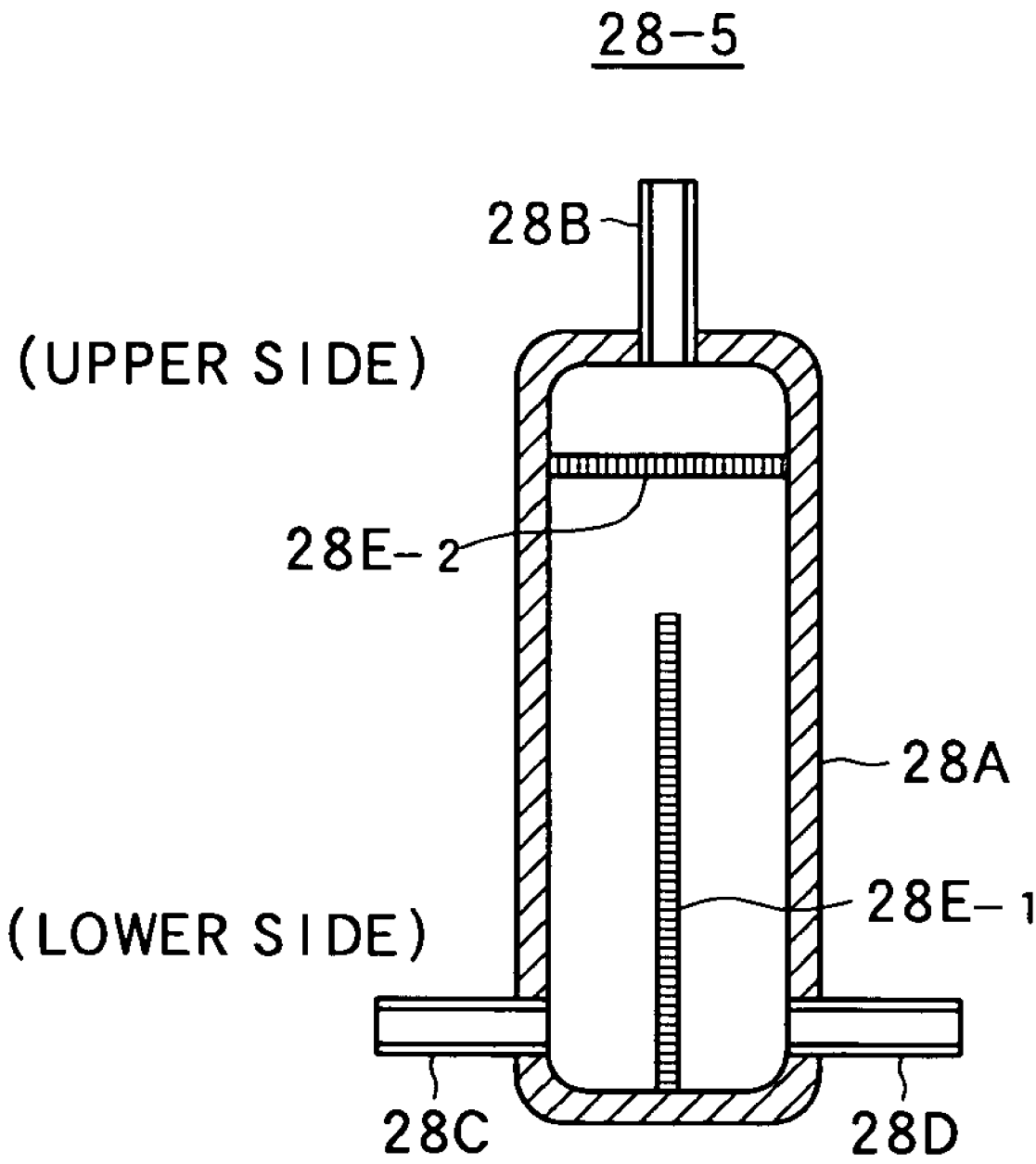
FIG. 9 is a diagram showing the construction of a fifth modification of the intermediate-pressure receiver.

FIG. 9 is a diagram showing a fifth embodiment of the intermediate-pressure receiver. In FIG. 9, the parts having the same functions as the intermediate-pressure receiver of FIG. 5 are represented by the same reference numerals.

The intermediate-pressure receiver 28-5 is mainly equipped with a receiver main body 28A, a gas outlet pipe 28B, a first inlet/outlet pipe 28C, a second inlet/outlet pipe 28D, a first separation promoting member 28E-1 for promoting gas-liquid separation and a second separation promoting member 28E-2.

The receiver main body 28A is formed as a hollow member having a substantially cylindrical outlook. A suction port (opening end) 9 of the gas outlet pipe 28B is formed at the center of the top surface at the upper portion side of the receiver main body 28A so as to face the inside of the receiver main body 28A. Furthermore, a plate-shaped first separation promoting member 28E-1 is formed so as to extend erectly from the bottom surface to the upper portion of the receiver main body 28A. A disc-shaped second separation promoting member 28E-2 is disposed at the lower side of the suction port of the gas outlet pipe 28B.

Each of the separation promoting members 28E-1, 28E-2 comprises a perforated board (baffle plate), a metal mesh or the like. The gas-liquid mixture refrigerant injected from the first inlet/outlet pipe 28C or the second inlet/outlet pipe 28D energetically impinges against the first separation promoting member 28E-1 to promote the gas-liquid separation. Furthermore, the mixture refrigerant which is not subjected to the gas-liquid separation by the first separation promoting member 28E-1, droplets of the refrigerant, etc. impinge against the second separation promoting member 28E-2 to promote the gas-liquid separation.

Furthermore, the opening end of the first inlet/outlet pipe 28C and the opening end of the second inlet/outlet pipe 28D are located on the side surface of the lower portion of the receiver main body 28A so as to be substantially vertical to the side wall of the receiver main body 28A and symmetrical with each other with respect to the gas outlet pipe 28B.

In this case, in accordance with the flow direction of the refrigerant in the intermediate-pressure pipe 13, any one of the first inlet/outlet pipe 28C and the second inlet/outlet pipe 28D also functions as an inlet pipe in which the gas-liquid mixture refrigerant flows while the other pipe functions as a liquid outlet pipe from which liquid refrigerant flows out after gas-liquid separation. In FIG. 9, the opening ends (discharge port or suction port) of the first inlet/outlet pipe 28C and the second inlet/outlet pipe 28D are illustrated as being near to the bottom surface of the receiver main body 28A, however, the opening ends (discharge port or suction port) of the first inlet/outlet pipe 28C and the second inlet/outlet pipe 28D may be located at any height of the lower portion of the receiver main body 28A so as to be spaced from the opening end of the gas outlet pipe 28B by a predetermined distance or more so that the liquid refrigerant is not sucked into the gas outlet pipe 28B. Furthermore, it is preferable that they are located at the same height, however, it is unnecessary that they are located at the same height.

Sixth Modification

Figure 10:
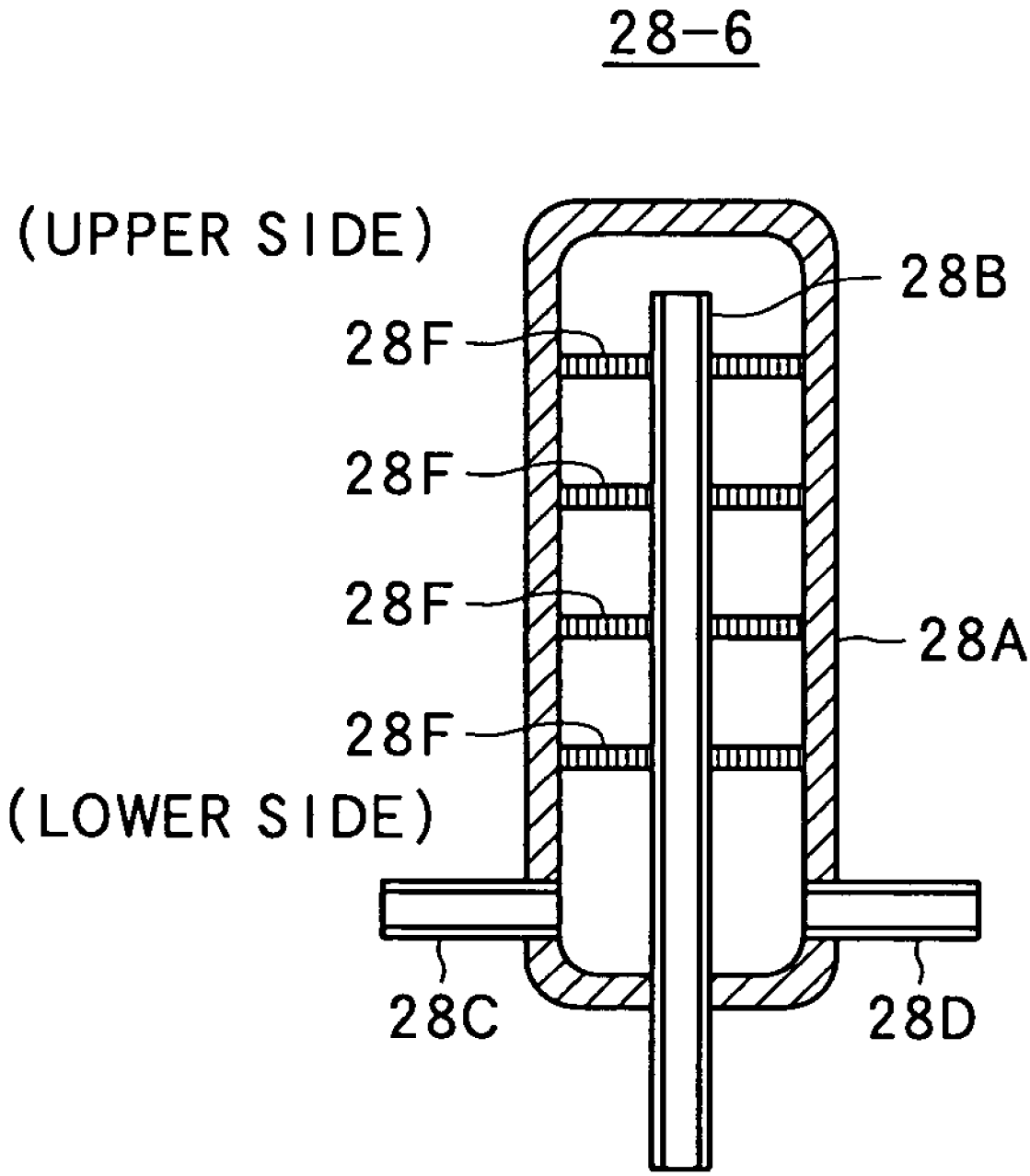
FIG. 10 is a diagram showing the construction of a sixth modification of the intermediate-pressure receiver.

FIG. 10 is a diagram showing a sixth modification of the intermediate-pressure receiver. In FIG. 10, the parts having the same functions as the intermediate-pressure receiver of FIG. 5 are represented by the same reference numerals.

An intermediate-pressure receiver 28-6 is mainly equipped with a receiver main body 28A, a gas outlet pipe 28B, a first inlet/outlet pipe 28C, a second inlet/outlet pipe 28D and plural separation promoting members 28F for promoting the gas-liquid separation.

The receiver main body 28A is designed as a hollow member having a substantially cylindrical outlook. A gas outlet pipe 28B is formed so as to extend erectly from the bottom surface of the receiver main body 28A to the upper portion thereof, and the opening end of the gas outlet pipe 28B is located at the upper portion side of the receiver main body 28A. Furthermore, the opening end of the first inlet/outlet pipe 28C and the opening end of the second inlet/outlet pipe 28D are located on the side surface of the lower portion of the receiver main body 28A so as to be substantially vertical to the side wall of the receiver main body 28A and symmetrical with each other through the gas outlet pipe 28B.

A plurality of disc-shaped separation promoting members 28F are disposed in the flow path of the receiver main body 28A extending from the opening end of the first inlet/outlet pipe 28C and the opening end of the second inlet/outlet pipe 28D to the opening end of the gas outlet pipe 28B so as to be spaced from one another at a predetermined distance. Specifically, the separation promoting members 28F comprise perforated boards (baffle plates), metal meshes or the like, and the gas-liquid separation is promoted when the refrigerant passes through each separation promoting member 28F.

In this case, in accordance with the flow direction of the refrigerant in the intermediate-pressure pipe 13, any one of the first inlet/outlet pipe 28C and the second inlet/outlet pipe 28D also functions as an inlet pipe in which the gas-liquid mixture refrigerant flows while the other pipe functions as a liquid outlet pipe from which liquid refrigerant flows out after gas-liquid separation. In FIG. 10, the opening ends (discharge port or suction port) of the first inlet/outlet pipe 28C and the second inlet/outlet pipe 28D are illustrated as being near to the bottom surface of the receiver main body 28A, however, the opening ends (discharge port or suction port) of the first inlet/outlet pipe 28C and the second inlet/outlet pipe 28D may be located at any height of the lower portion of the receiver main body 28A so as to be spaced from the opening end of the gas outlet pipe 28B by a predetermined distance or more so that the liquid refrigerant is not sucked into the gas outlet pipe 28B. Furthermore, it is preferable that they are located at the same height, however, it is unnecessary that they are located at the same height.

Seventy Modification

Figure 11:
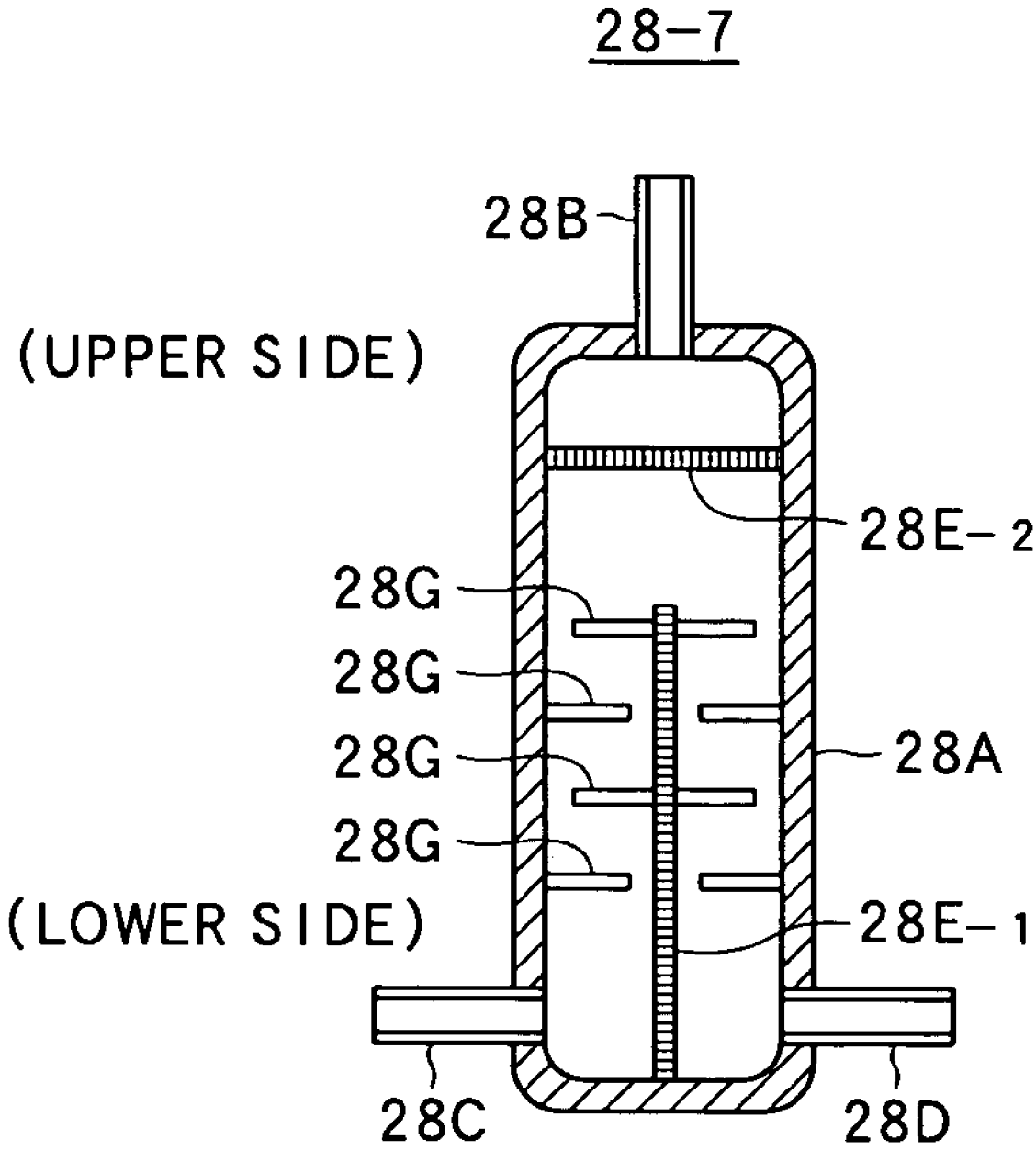
FIG. 11 is a diagram showing the construction of seventh modification of the intermediate-pressure receiver.

FIG. 11 is a diagram showing a seventh modification of the intermediate-pressure receiver. In FIG. 11, the parts having the same functions as the intermediate-pressure receiver of FIG. 9 are represented by the same reference numerals.

An intermediate-pressure receiver 28-7 is mainly equipped with a receiver main body 28A, a gas outlet pipe 28B, a first inlet/outlet pipe 28C, a second inlet/outlet pipe 28D, a first separation promoting member 28E-1 for promoting gas-liquid separation, a second separation promoting member 28E-2, and plural third separation promoting member 28*g*.

The receiver main body 28A is designed as a hollow member having a substantially cylindrical outlook. A suction port (opening end) of the gas outlet pipe 28B is formed at the center of the top surface at the upper portion side of the receiver main body 28A so as to face the inside of the receiver main body 28A. The plate-shaped first separation promoting member 27E-1 is erectly provided so as to extend from the bottom surface of the receiver main body 28A to the upper portion thereof. Furthermore, the disc-shaped second separation promoting member 28E-2 is disposed below the suction port of the gas outlet pipe 28B. Furthermore, the plural disc-shaped or annular (doughnut-shaped) third separation promoting members 28*g* are disposed on the outer wall of the gas outlet pipe 28B or the inner wall of the receiver main body 28 along the extending direction of the gas outlet pipe 28B so as to be spaced from one another at predetermined distances.

Specifically, the separation promoting members 28E-1 and 28E-2 comprise perforated boards (baffle plates), metal meshes or the like.

The third separation promoting members 28G comprise metal plates or the like. The refrigerant injected from the first inlet/outlet pipe 28C or the second inlet/outlet pipe 28D energetically impinges against the first separation promoting member 28E-1 to promote the gas-liquid separation. Furthermore, mixture refrigerant which is not subjected to the gas-liquid separation by the first separation promoting member 28E-1 or droplets of the refrigerant impinge against the third separation promoting members 28G to promote the gas-liquid separation, and then the refrigerant is led to the second separation promoting member 28E-2.

Furthermore, the mixture refrigerant which is not subjected to the gas-liquid separation even by the first separation promoting member 28E-1 and the third separation promoting members 28G or droplets of the refrigerant impinge against the second separation promoting member 28E-2, so that the gas-liquid separation is further promoted.

Furthermore, the opening end of the first inlet/outlet pipe 28C and the opening end of the second inlet/outlet pipe 28D are disposed on the side surface of the lower portion of the receiver main body 28A so as to be substantially vertical to the side wall of the receiver main body 28A and symmetrical with each other with respect to the gas outlet pipe 28B.

In this case, in accordance with the flow direction of the refrigerant in the intermediate-pressure pipe 13, any one of the first inlet/outlet pipe 28C and the second inlet/outlet pipe 28D also functions as an inlet pipe in which the gas-liquid mixture refrigerant flows while the other pipe functions as a liquid outlet pipe from which liquid refrigerant flows out after gas-liquid separation. In FIG. 11, the opening ends (discharge port or suction port) of the first inlet/outlet pipe 28C and the second inlet/outlet pipe 28D are illustrated as being near to the bottom surface of the receiver main body 28A, however, the opening ends (discharge port or suction port) of the first inlet/outlet pipe 28C and the second inlet/outlet pipe 28D may be located at any height of the lower portion of the receiver main body 28A so as to be spaced from the opening end of the gas outlet pipe 28B by a predetermined distance or more so that the liquid refrigerant is not sucked into the gas outlet pipe 28B. Furthermore, it is preferable that they are located at the same height, however, it is unnecessary that they are located at the same height.

Eighth Embodiment

Figure 12:
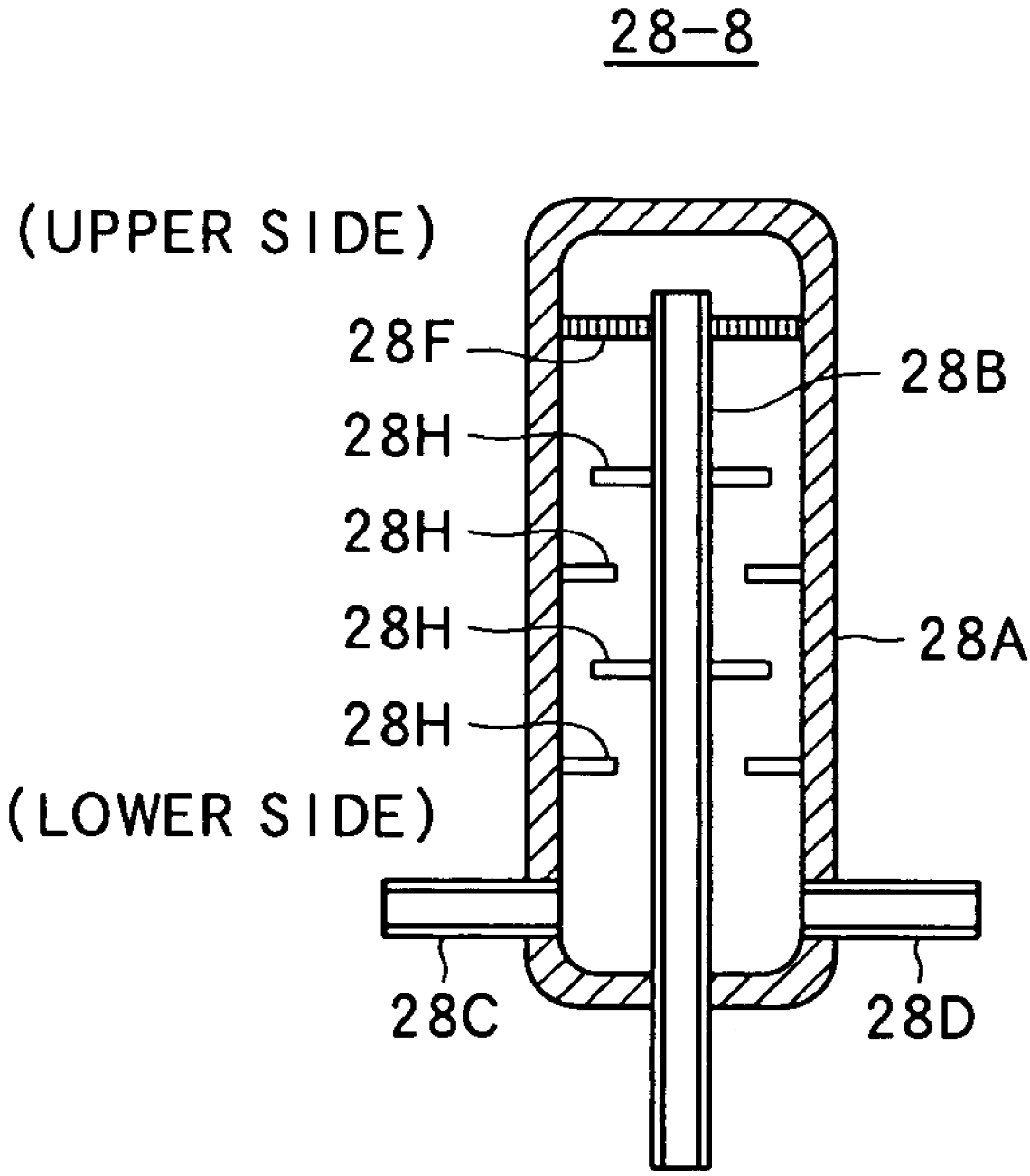
FIG. 12 is a diagram showing the construction of an eighth modification of the intermediate-pressure receiver.

FIG. 12 is a diagram showing an eighth embodiment of the intermediate-pressure receiver. In FIG. 12, the parts having substantially the same functions as the intermediate-pressure receiver of FIG. 10 are represented by the same reference numerals.

An intermediate-pressure receiver 28-8 is mainly equipped with a receiver main body 28A, a gas outlet pipe 28B, a first inlet/outlet pipe 28C, a second inlet/outlet pipe 28D, a separation promoting member 28F for promoting gas-liquid separation and plural separation promoting members 28H for promoting the gas-liquid separation.

The receiver main body 28A is formed as a hollow member having a substantially cylindrical outlook. The gas outlet pipe 28B is erectly provided so as to extend from the bottom surface of the receiver main body 28A to the upper portion thereof, and the opening end of the gas outlet pipe 28B is located at the upper portion of the receiver main body 28A. Furthermore, the opening end of the first inlet/outlet pipe 28C and the opening end of the second inlet/outlet pipe 28D are located on the side surface of the lower portion of the receiver main body 28A so as to be substantially vertical to the side wall of the receiver main body 28A and symmetrical with each other with respect to the gas outlet pipe 28B.

The disc-shaped separation promoting member 28F is disposed in the flow path of the receiver main body 28A which extends from the opening end of the first inlet/outlet pipe 28C and the opening end of the second inlet/outlet pipe 28D to the opening end of the gas outlet pipe 28B. Specifically, the separation promoting member 28F comprises a perforated board (baffle plate), a metal mesh or the like, and the gas-liquid separation is promoted when the refrigerant passes through the separation promoting member 28F. Furthermore, the separation promoting members 28H comprise metal plates or the like. Gas-liquid mixed refrigerant which is introduced into the receiver main body 28A, but not subjected to the gas-liquid separation or droplets thereof impinge against the separation promoting members 28H to promote the gas-liquid separation, and then is led to the separation promoting member 28F.

In this case, in accordance with the flow direction of the refrigerant in the intermediate-pressure pipe 13, any one of the first inlet/outlet pipe 28C and the second inlet/outlet pipe 28D also functions as an inlet pipe in which the gas-liquid mixture refrigerant flows while the other pipe functions as a liquid outlet pipe from which liquid refrigerant flows out after gas-liquid separation. In FIG. 12, the opening ends (discharge port or suction port) of the first inlet/outlet pipe 28C and the second inlet/outlet pipe 28D are illustrated as being near to the bottom surface of the receiver main body 28A, however, the opening ends (discharge port or suction port) of the first inlet/outlet pipe 28C and the second inlet/outlet pipe 28D may be located at any height of the lower portion of the receiver main body 28A so as to be spaced from the opening end of the gas outlet pipe 28B by a predetermined distance or more so that the liquid refrigerant is not sucked into the gas outlet pipe 28B. Furthermore, it is preferable that they are located at the same height, however, it is unnecessary that they are located at the same height.

In the foregoing description, the second-stage (low-pressure side) expansion valve is controlled so that the temperature difference (so-called superheat degree) between the temperature detected by the temperature sensor disposed at the center portion of the heat exchanger used as an evaporator and the temperature detected by the temperature sensor disposed at the exit portion of the heat exchanger concerned is set to a fixed value, and the first-stage (high-pressure side) expansion valve is controlled so that the discharge temperature is equal to a predetermined value. Here, the predetermined value of the discharge temperature is determined from the exit temperature of the heat exchanger used as a radiation side heat exchanger and the temperature of the heat exchanger functioning as an evaporator. A predetermined value is used so that the cycle efficiency is optimal, and the compressor is subjected to capacitance control (control in rotational number) in accordance with a load, however, another value may be used for the control amount to perform the same control.

(1) The pressure of the evaporator, the outdoor air temperature or the indoor temperature may be used in place of the temperature of the evaporator.

(2) The outdoor air temperature, the indoor temperature or the supply water temperature may be used in place of the exit temperature of the radiation side heat exchanger.

(3) The pressure at the high-pressure side may be used in place of the discharge temperature.

The first-stage expansion valve may be operated so as to have a predetermined opening degree which is determined from the exit temperature of the heat exchanger used as the radiation side heat exchanger and the temperature of the heat exchanger functioning as the evaporator, and the second-stage expansion valve my be controlled so that the superheat degree of the heat exchanger used as the evaporator is equal to a fixed value.

In the foregoing description, the hot-water stocking unit is used as a thermal storage unit. However, a cold water (ice) thermal storage unit may be considered as a thermal storage unit using water as a thermal storage medium. In this case, the cold water (ice) thermal storage unit may be used in place of the hot-water stocking unit or in addition to the hot-water stocking unit, or it is also used as a hot-water stocking unit.

In this case, when the cold water (ice) thermal storage unit is used in place of the hot-water stocking unit, the switching valve 48 connected to the high-pressure pipe 11 may be connected to the low-pressure pipe 12. Furthermore, when the cold water (ice) thermal storage unit is used in addition to the hot-water stocking unit, it may be designed in the same construction as the hot-water stocking unit, and the switching valve may be connected to the low-pressure pipe 12. Still furthermore, when the cold water (ice) thermal storage unit is also used as a hot-water stocking unit, a second switching valve which is exclusively kept to be opened to the switching valve 48 may be provided so as to be connected to the low-pressure pipe 12.

What is claimed is:

1. A refrigerating machine equipped with an outdoor unit containing a compressor and an outdoor heat exchanger serving as a heat-source side heat exchanger, a plurality of indoor units each of which contains an indoor heat exchanger as a using side heat exchanger and is connected to the outdoor unit through an inter-unit pipe, one end of the outdoor heat exchanger being selectively connected to any one of a refrigerant discharge pipe and a refrigerant suction pipe of the compressor, the inter-unit pipe comprising a high-pressure pipe connected to the refrigerant discharge pipe, a low-pressure pipe connected to the refrigerant suction pipe and an intermediate-pressure pipe connected to the other end of the outdoor heat exchanger, and one end of the indoor heat exchanger of each of the indoor units being selectively connected to any one of the high-pressure pipe and the low-pressure pipe while the other end of the indoor heat exchanger concerned is connected to the intermediate-pressure pipe, whereby the plural indoor units carry out any one of cooling operation and heating operation at the same time or carry out both cooling operation and heating operation in mixture at the same time, characterized in that the compressor has an intermediate-pressure portion in which refrigerant having intermediate pressure higher than the pressure of the refrigerant at the suction side of the compressor and lower than the pressure of the refrigerant at the discharge side of the compressor is allowed to be introduced, and an intermediate-pressure receiver that is inserted in a refrigerant flow path between the heat-source side heat exchanger and the using side heat exchanger to carry out gas-liquid separation on gas-liquid mixed refrigerant after heat exchange in the heat-source side heat exchanger or the using side heat exchanger and then feed gas-phase refrigerant to the intermediate-pressure portion.

2. The refrigerating machine according to claim 1, wherein the intermediate-pressure receiver has a receiver main body including a first inlet/outlet pipe, a second inlet/outlet pipe and a gas outlet pipe, the gas-liquid mixed refrigerant is injected into any one of the first inlet/outlet pipe and the second inlet/outlet pipe while liquid-phase refrigerant after the gas-liquid separation is discharged from the other inlet/outlet pipe, and the gas-phase refrigerant is discharged from the gas outlet pipe.

3. The refrigerating machine according to claim 1, wherein the inside of the high-pressure pipe connected to the refrigerant discharge pipe is operated under supercritical pressure during an operation of the refrigerating machine.

4. The refrigerating machine according to claim 3, wherein carbon dioxide refrigerant is used as the refrigerant.

5. The refrigerating machine according to claim 1, further comprising a thermal storage unit using water as a thermal storage medium that is provided as one of the using side heat exchangers between the high-pressure pipe and the intermediate-pressure pipe.

6. An intermediate-pressure receiver comprising:

a receiver main body in which gas-liquid separation of refrigerant is carried out;

a first inlet/outlet pipe and a second inlet/outlet pipe provided to the receiver main body, gas-liquid mixed refrigerant being injected through any one of the first and second inlet/outlet pipes into the receiver main body while liquid-phase refrigerant after the gas-liquid separation is discharged from the other inlet/outlet pipe; and a gas outlet pipe provided to the receiver main body, gas-phase refrigerant after the gas-liquid separation being discharged from the gas outlet pipe.

7. The intermediate-pressure receiver according to claim 6, wherein one end of the gas outlet pipe is opened at the upper portion of the receiver main body, and one end of the first inlet/outlet pipe and one end of the second inlet/outlet pipe are opened at the lower portion of the receiver main body.

8. The intermediate-pressure receiver according to claim 7, wherein the receiver main body has a substantially cylindrical hollow shape.

9. The intermediate-pressure receiver according to claim 8, wherein the first inlet/outlet pipe and the second inlet/outlet pipe are disposed so as to be displaced from each other with respect to the radial direction of the receiver main body.

10. The intermediate-pressure receiver according to claim 8, wherein the first inlet/outlet pipe and the second inlet/outlet pipe are designed so that one ends thereof are projected into the inside of the receiver main body and bent so as to be displaced from each other with respect to the radial direction of the receiver main body.

11. The intermediate-pressure receiver according to claim 6, wherein the opening end of the first inlet/outlet pipe and the opening end of the second inlet/outlet pipe are disposed so as not to face each other.

12. The intermediate-pressure receiver according to claim 6, further comprising a separation promoting member for promoting the gas-liquid separation of the gas-liquid mixed refrigerant.

13. The intermediate-pressure receiver according to claim 12, wherein the separation promoting member comprises a baffle plate or a metal mesh.

14. The intermediate-pressure receiver according to claim 12, wherein the separation promoting member comprises a plate-shaped member that is provided in the receiver main body so as to extend from the bottom surface of the receiver main body to the upper portion of the receiver main body.

15. The intermediate-pressure receiver according to claim 14, wherein the separation promoting member further comprises a disc-shaped member provided above the plate-shaped member in the receiver main body.

16. The intermediate-pressure receiver according to claim 12, wherein the separation promoting member comprises a plurality of disc-shaped members disposed so as to be spaced from one another at predetermined intervals.

17. The intermediate-pressure receiver according to claim 12, wherein the separation promoting member comprises a plurality of annular members disposed so as to be spaced from one another at predetermined intervals.

* * * * *